US008111228B2

(12) United States Patent
Ruckmongathan

(10) Patent No.: US 8,111,228 B2
(45) Date of Patent: Feb. 7, 2012

(54) METHOD AND DEVICE TO OPTIMIZE POWER CONSUMPTION IN LIQUID CRYSTAL DISPLAY

(75) Inventor: T. N. Ruckmongathan, Karnataka (IN)

(73) Assignee: Raman Research Institute, Bangalore (IN)

( * ) Notice: Subject to any disclaimer, the term of this patent is extended or adjusted under 35 U.S.C. 154(b) by 723 days.

(21) Appl. No.: 11/819,039

(22) Filed: Jun. 25, 2007

(65) Prior Publication Data

US 2008/0303772 A1 Dec. 11, 2008

(30) Foreign Application Priority Data

Jun. 11, 2007 (IN) ..... 01206/CHE/2007

(51) Int. Cl.
*G09G 3/36* (2006.01)

(52) U.S. Cl. ..... 345/95; 345/210
(58) Field of Classification Search ..... 345/87–104, 345/204, 690–699, 208–210
See application file for complete search history.

(56) References Cited

U.S. PATENT DOCUMENTS 4,395,709 A * 7/1983 Nagae et al. ..... 345/94
4,931,787 A * 6/1990 Shannon ..... 345/93
5,069,532 A * 12/1991 Taylor, Jr. ..... 345/97
5,684,501 A * 11/1997 Knapp et al. ..... 345/94
6,232,944 B1 * 5/2001 Kumagawa et al. ..... 345/98
7,518,588 B2 * 4/2009 Lin ..... 345/98
2001/0026259 A1 * 10/2001 McKnight ..... 345/95
2002/0186230 A1 * 12/2002 Kudo et al. ..... 345/690

OTHER PUBLICATIONS

Marks, "Power Consumption of Multiplexed Liquid-Crystal Displays", IEEE Transactions of Electron Device, vol. Ed-29, No. 8, Aug. 1982.
Marks, "Power Reduction in Liquid-Crystal Display Modules", IEEE Transactions on Electron Devices, vol. ED-29, No. 12, Dec. 1982.

* cited by examiner

*Primary Examiner* — Stephen Sherman
(74) *Attorney, Agent, or Firm* — Fenwick & West LLP

(57) ABSTRACT

Power consumption in liquid crystal displays is analyzed by including frequent polarity reversals and duty cycle control. A multi-step voltage profile is proposed to reduce the power consumption in multiplexed and non-multiplexed displays. The present invention relates to a method to optimize power consumption in Liquid Crystal Display, wherein said method comprises steps of applying multi-step waveform for selecting pre-determined address lines, maintaining ratio of step-width ($T_s$) and pulse width (T) between 0.02 to 0.25, and making final step duration ($T_f$) greater than or equal to twice the step width ($T_s$) to optimize power supply of the Liquid Crystal Display and apply a correction voltage if the distortion is significant and modifying the step sizes to reduce the supply voltage of the driver.

16 Claims, 9 Drawing Sheets

METHOD AND DEVICE TO OPTIMIZE POWER CONSUMPTION IN LIQUID CRYSTAL DISPLAY

FIELD OF INVENTION

Figure 1:
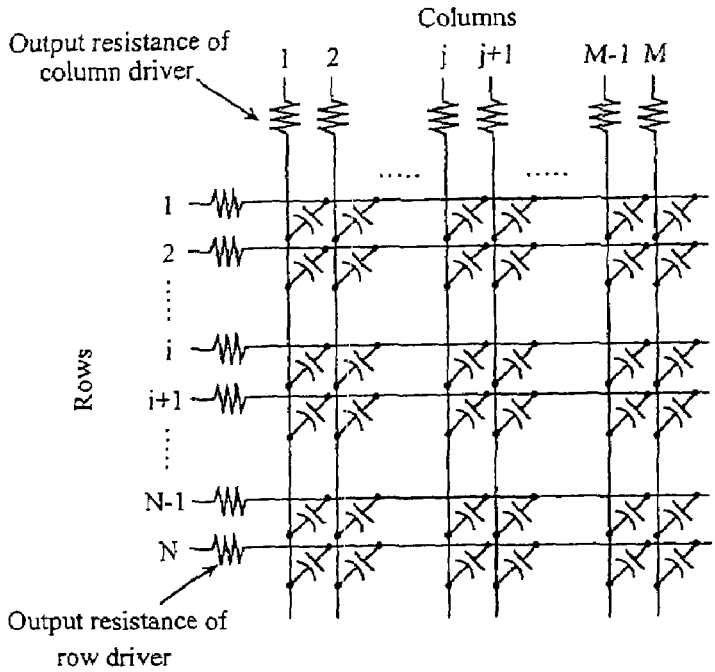

Liquid Crystal Displays (LCDs) consume less power as compared to other display devices. They are also flat panel devices with negligible depth. LCDs can be operated with low voltage power sources and hence are extensively used in portable products. Although liquid crystal displays consume less power, it is desirable to reduce the power consumption further so that the frequency of replacing or charging the cells in portable equipment is reduced. We have used the multi-step waveform profile to reduce power consumption in liquid crystal displays.

BACKGROUND OF INVENTION

Marks [1] has shown that the power consumption of non-multiplexed displays can be reduced to about 50% when the charge across the pixels is discharged by shorting the two electrodes for a short time interval before charging the pixels to a voltage with opposite polarity. He has also analyzed and estimated the power consumption in multiplexed LCDs [2], based on the model of the matrix display shown in FIG. 1. Each pixel in the LCD is represented as a capacitor. One electrode of the pixel is connected to a row address line and the other electrode is connected to a column address line. Capacitance of pixel depends on the state of the pixel since the effective dielectric constant is determined by the orientation of the liquid crystal molecules. The capacitance of the ON pixel $C_{on}$ is at least twice the capacitance of the OFF pixel $C_{off}$ in nematic liquid crystal displays because the dielectric constant of the rod-like liquid crystal molecules is higher when measured parallel to its long axis as compared to the other two perpendicular directions.

Display drivers are used to apply the waveforms to the rows and columns of the matrix display. Power consumption of the panel is the power dissipated in the resistors while charging and discharging the pixels to voltages as dictated by the addressing technique. Marks [2] has estimated the power consumption in a matrix display driven by the conventional line-by-line addressing when the worst-case pattern that consists of alternate ON and OFF pixels is displayed. He has shown that the power consumed by the multiplexed display is proportional to $N^2M$. Here, N is the number of lines multiplexed and M is the number of columns in the matrix display. This analysis is restricted to just one polarity inversion per frame. Frequent polarity reversal is introduced in the addressing waveforms to improve the brightness uniformity of the display. It induces transitions in places where there were no transitions and suppresses transitions in some other places. Polarity of the addressing waveforms is changed after scanning few address lines in most of the passive matrix LCDs. We have extended the analysis of power consumption in the line-by-line addressing technique by including polarity inversion as an additional parameter.

Power is dissipated in the drive circuit when pixels in the passive matrix displays are charged and discharged. Substituting the select pulses in the scanning waveforms with multi-step waveforms will reduce the power dissipation. The rows in the matrix displays are selected with a pulse because they are easy to generate.

Analysis of Line-by-Line Addressing with Multiple Polarity Inversions in a Frame Let $V_r$ and $V_c$ be the amplitudes of the row and column voltages. Let $n_p$ be the number of polarity inversions in a frame (Marks had assumed $n_p$=1 in his analysis) and f be the frame frequency of the line-by-line addressing. Let $C_{on}$ and $C_{off}$ be the capacitance of the pixels in ON and OFF states respectively. Table I gives the voltage transition across the pixels based on the two neighboring pixels in a column when the row (i) is unselected and the row (i+1) is selected. These transitions depend on the state of the pixels in rows (i) and (i+1) as well as the polarity inversion. The voltage transitions when a polarity inversion is introduced are shown within the parentheses.

TABLE I

VOLTAGE TRANSITIONS ACROSS PIXELS IN LINE-BY-LINE ADDRESSING

| State of the pixel in | | Voltage swing across the pixels in | | |
|---|---|---|---|---|
| Row (i) | row (i + 1) | row (i) | row (i + 1) | other rows |
| ON | ON | $V_r$ ($V_r + 2V_c$) | $V_r$ ($V_r + 2V_c$) | 0 ($2V_c$) |
| ON | OFF | $V_r + 2V_c$ ($V_r$) | $V_r - 2V_c$ ($V_r$) | $2V_c$ (0) |
| OFF | ON | $V_r - 2V_c$ ($V_r$) | $V_r + 2V_c$ ($V_r$) | $2V_c$ (0) |
| OFF | OFF | $V_r$ ($V_r - 2V_c$) | $V_r$ ($V_r - 2V_c$) | 0 ($2V_c$) |

Case 1: Power consumed by a blank screen when all the pixels are OFF. Power consumed in a column during a transition i.e., when the row (i+1) is selected and polarity of the voltages applied to the two rows remains unchanged is as follows.

$$P_{tran.} = \frac{C_{off}V_r^2}{2} + \frac{C_{off}V_r^2}{2} + (N-2)C_{off}(0) = C_{off}V_r^2 \tag{1}$$

The first term corresponds to the power dissipated while discharging the pixel in row (i) from $V_r$–$V_c$ to –$V_c$ and the second term corresponds to the charging the pixels in row (i+1) from –$V_c$ to $V_r$–$V_c$ while the third term corresponds to the rest of the (N–2) pixels in a column without any change in the voltage across them. Similarly, the power dissipated when the polarity of the select voltage changes is given in (2).

$$P'_{tran.} = \frac{C_{off}(V_r - 2V_c)^2}{2} + \frac{C_{off}(V_r - 2V_c)^2}{2} + (N-2)\frac{C_{off}(2V_c)^2}{2} \tag{2}$$

Power consumption in a column during a frame is given by $$P_{column}(\text{frame}) = (N-n_p)P_{tran.} + n_p P'_{tran.} \tag{3}$$

Power consumed by the whole display panel is obtained by multiplying (3) by M, the number of columns in the display and f, the frame frequency as shown in the following equation.

$$P_{ALL_OFF} = MC_{off}V_c^2(N^2 + n_p(2N - 4\sqrt{N}))f \tag{4}$$

Case 2: Power consumed by a blank screen, when all the pixels are ON is given in the following expression.

$$P_{ALL_ON} = MC_{on}V_c^2(N^2 + n_p(2N + 4\sqrt{N}))f \tag{5}$$

Case 3: Power consumed when a checkerboard pattern is displayed is given in (6). Here, the number of pixels in ON and OFF states are equal and the neighboring pixels in the vertical as well as the horizontal direction are in the opposite states.

$$P_{ON_OFF} = \frac{MV_c^2}{2}\left[\begin{array}{l} C_{on}\left(3N^2 + 4N\sqrt{N} - n_p\left(2N + 4\sqrt{N}\right)\right) + \\ C_{off}\left(3N^2 - 4N\sqrt{N} - n_p\left(2N - 4\sqrt{N}\right)\right) \end{array}\right] f \quad (6)$$

We have also introduced duty cycle in the pulses of the line-by-line addressing technique. Power consumption after the inclusion of duty cycle is analyzed and compared in the next section.

REFERENCES

[1] Burton. W. Marks, "Power reduction in liquid crystal display modules", *IEEE Trans. Electron Devices*, Vol. ED-29, No. 12, pp. 1884-1886, 1982.

[2] Burton. W. Marks, "Power consumption of multiplexed liquid crystal displays", *IEEE Trans. Electron Devices*, Vol. ED-29, No. 8, pp. 1218-1222, 1982.

[3] T. N. Ruckmongathan, M. Govind and G. Deepak, "Reducing power consumption in liquid crystal displays" *IEEE Trans. Electron Devices*, submitted for publication.

[4] T. N. Ruckmongathan, Techniques for Reducing the Hardware Complexity and the Power Consumption of Drive Electronics, Proceedings of the Asian Symposium on Information Display (ASID'06), Oct. 8-12, 2006, pp 115-120.

BRIEF DESCRIPTION OF ACCOMPANYING DRAWINGS

FIG. 1: shows a model of matrix display used for computing power consumption.

Figure 2:
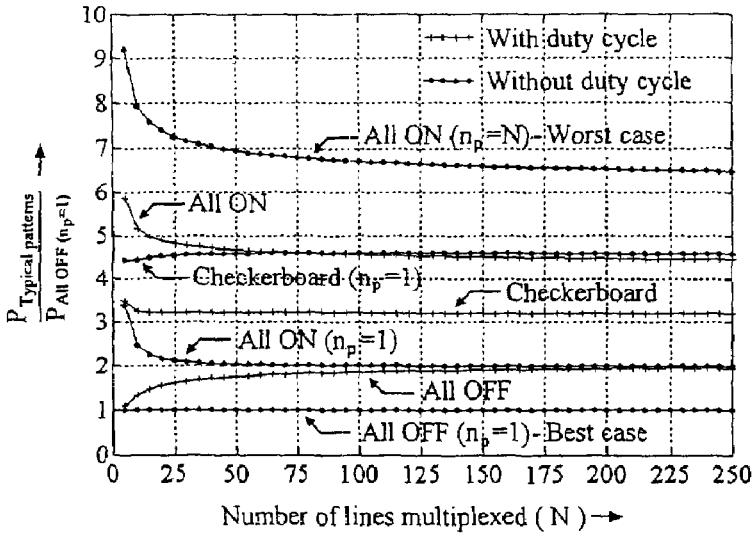

FIG. 2: shows plots of normalized power consumption in matrix displays driven by line-by-line addressing with duty cycle control and the conventional line-by line addressing without duty cycle control and $n_p$ polarity inversions in a frame.

Figure 3:
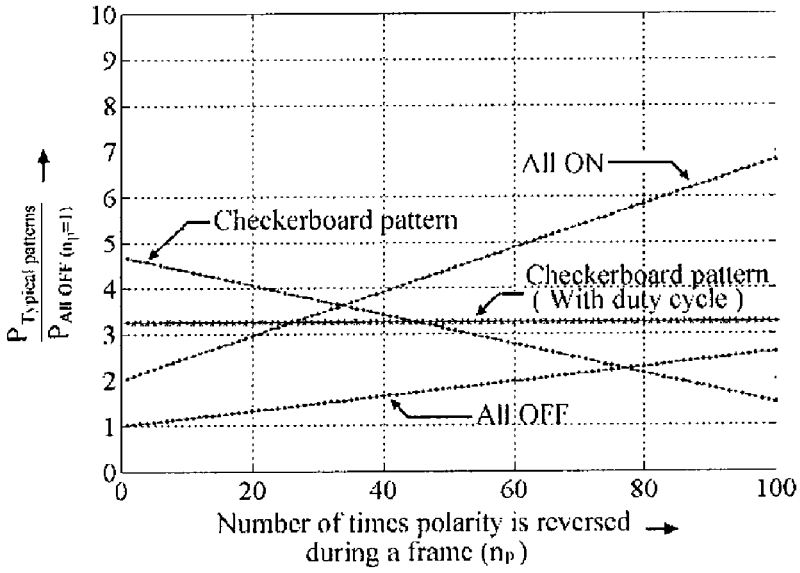

FIG. 3: shows plot of normalized power consumption as a function of $n_p$, the number of polarity inversions in a frame (N=100). These plots are normalized to power consumed when the screen is blank and $n_p$ is one.

Figure 4:
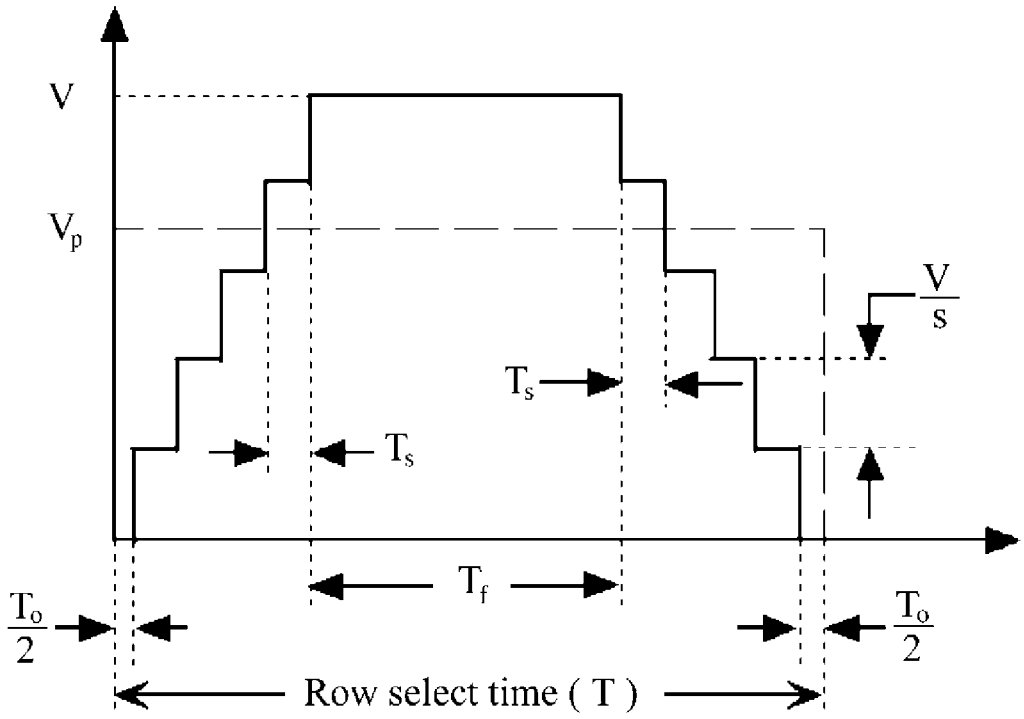

FIG. 4: shows a multi-step voltage profile that will replace a pulse of amplitude Vp in the addressing techniques.

Figure 5:
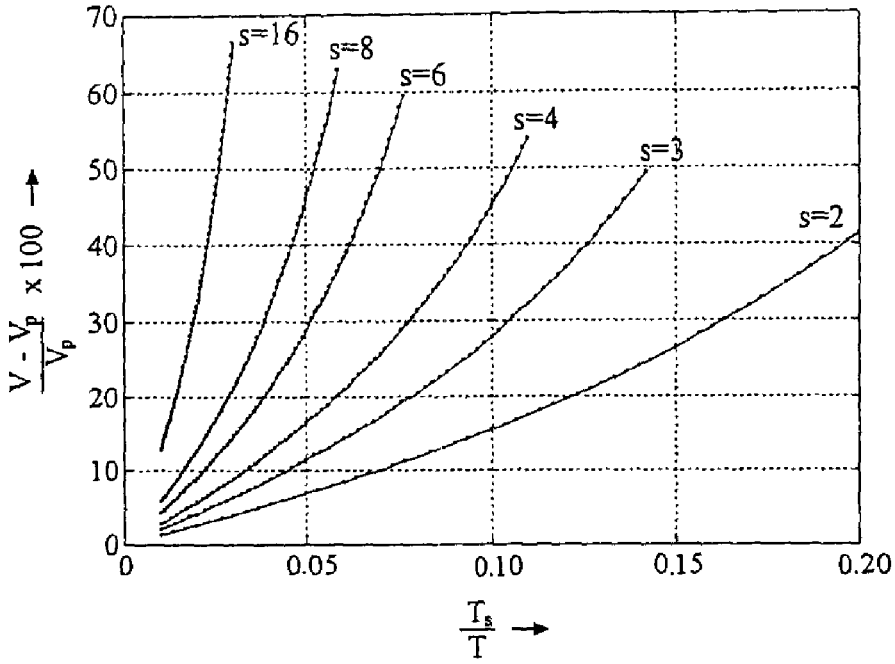

FIG. 5: shows plot of the percentage increase in maximum amplitude of the multi-step voltage profile for several values of 's', the number of steps in a multi-step voltage profile when $T_0=T_s$, $T_f \geqq 2T_s$ and $T_s \geqq 0.01T$.

Figure 6:
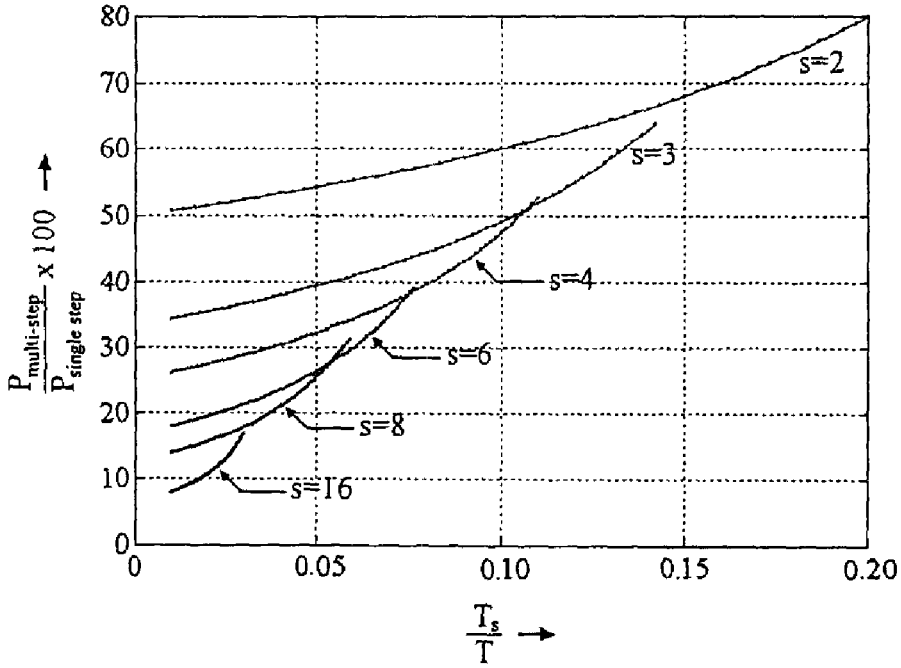

FIG. 6: shows plot of ratio of power consumption for several values of s, the number of steps in the multi-step voltage profile. Power consumption is normalized to that of a pulse having a duty cycle ($T_0=T_s$) with $T_f \geqq 2T_s$ and $T_s \geqq 0.01T$.

Figure 7:
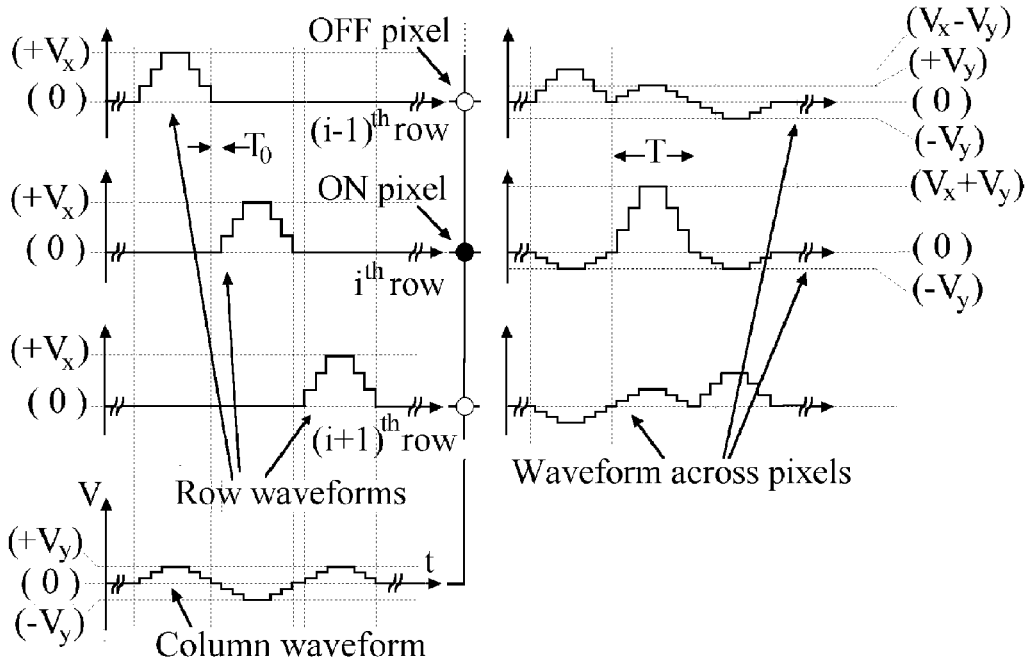
Figure 8:
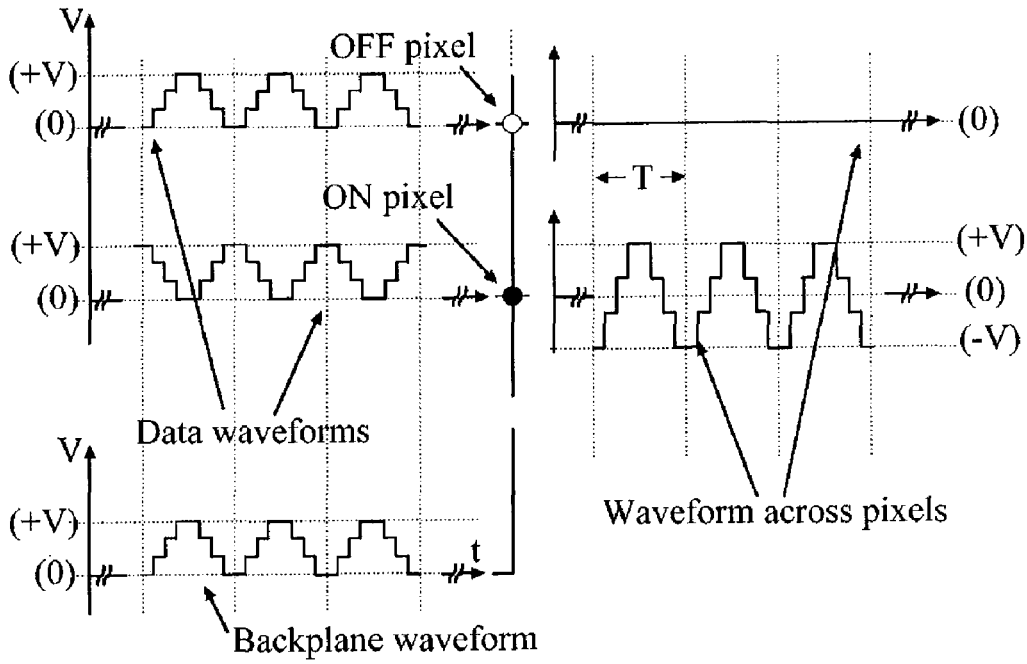
Figure 9:
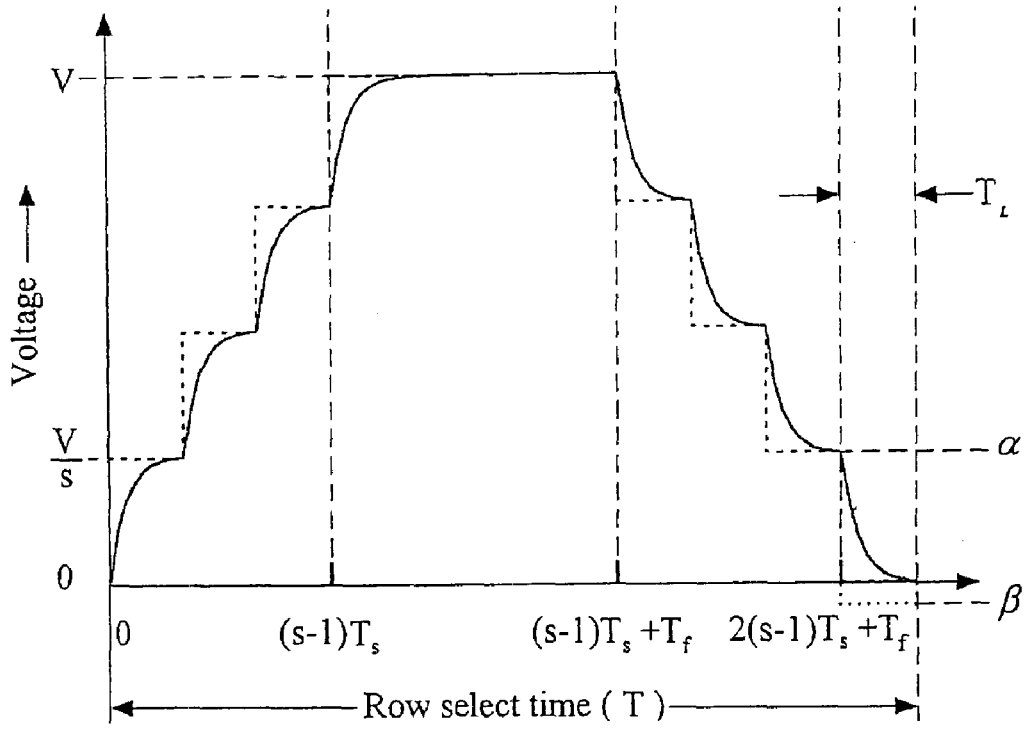

FIG. 7: shows typical waveforms when multi-steps are introduced in line-by-line addressing FIG. 8: shows typical waveforms when multi-steps are introduced in static drive FIG. 9: Multi-step waveform profile with RC distortion and s=4. Ideal waveform is shown in dotted lines and it is held at zero during $T_L$ FIG. 10: Power dissipation (normalized to that of a single pulse) vs. normalized time constant for different values of S; $T_L=0.1T$ and $T_f=2T_s$ FIG. 11: Peak voltage (normalized to that of a single pulse) vs. normalized time constant for different values of S; $T_L=0.1T$ and $T_f=2T_s$ FIG. 12: Magnitude of voltage to be applied during $T_L$ (normalized to the corrected peak voltage) as a function of normalized time constant; $T_L=0.1T$ and $T_f=2T_s$ FIG. 13: Shows a system block diagram with two Voltage Level Generators (VLG) to provide voltages to LCD drivers along with multiplexer.

OBJECTS OF THE INVENTION

The primary objective of the invention is to develop a method to optimize power and improve brightness uniformity of pixels consumption in Liquid Crystal Display.

Another objective of the invention is applying multi-step waveform for selecting pre-determined address lines.

Still another objective of the present invention is maintaining ratio of step-width ($T_s$) and pulse width (T) between 0.02 to 0.25.

Still another objective of the present invention is making final step duration ($T_f$) greater than or equal to twice the step width ($T_s$) to optimize the supply voltage of the driver circuit of the Liquid Crystal Display.

STATEMENT OF INVENTION

The present invention is related to a method to optimize power consumption and improve brightness uniformity of pixels in Liquid Crystal Display, wherein said method comprises steps of: applying a multi-step waveform for selecting pre-determined address lines of the LCD, wherein said multi-step waveform comprises ascending steps and descending steps maintaining ratio of step-width ($T_s$) and pulse width (T) between 0.02 to 0.25; making top most step duration ($T_f$) greater than or equal to twice the step width ($T_s$); and applying a negative voltage to make voltage across the pixels zero at the end of multi-step time interval to optimize power supply voltage in Liquid Crystal Display; a device to optimize power consumption and improve brightness uniformity of pixels in Liquid Crystal Display, wherein said device comprises: voltage level generator (VLG) to provide voltages to the drivers, and analog multiplexer (number of steps: 1) with variable resistor (Rs) connected to the VLG wherein Rs is dictated by multi-step waveform to determine the voltage applied to the LCD;

DETAILED DESCRIPTION OF THE INVENTION

The primary embodiment of the invention is a method to optimize (reduce) power consumption and improve brightness uniformity of pixels in Liquid Crystal Display, wherein said method comprises steps of applying a multi-step waveform for selecting pre-determined address lines of the LCD, wherein said multi-step waveform comprises ascending steps and descending steps; maintaining ratio of step-width ($T_s$) and pulse width (T) between 0.02 to 0.25; making top most step duration ($T_f$) greater than or equal to twice the step width ($T_s$); and applying a negative voltage to make voltage across the pixels zero at the end of multi-step time interval to optimize power supply voltage in Liquid Crystal Display.

In yet another embodiment of the present invention the number of steps is ranging from 2 to 16.

In still another embodiment of the present invention, the step-width (Ts) is not same for all steps.

In still another embodiment of the present invention applying a voltage of opposite polarity to that of peak voltage as the last step ($T_L$) of multi-step waveform to bring the multi-step waveform to zero at the end of the period 'T'.

In still another embodiment of the present invention, amplitude of the voltage is less than the peak voltage of the multi-step waveform profile.

In still another embodiment of the present invention, amplitude of the multi-step waveform is varied to increase energy delivered to the pixels.

In still another embodiment of the present invention, amplitude of first step of the multi-step waveform is increased.

In still another embodiment of the present invention, amplitude of the entire steps is increased uniformly.

In still another embodiment of the present invention, amplitude of topmost step is increased.

Figure 13:
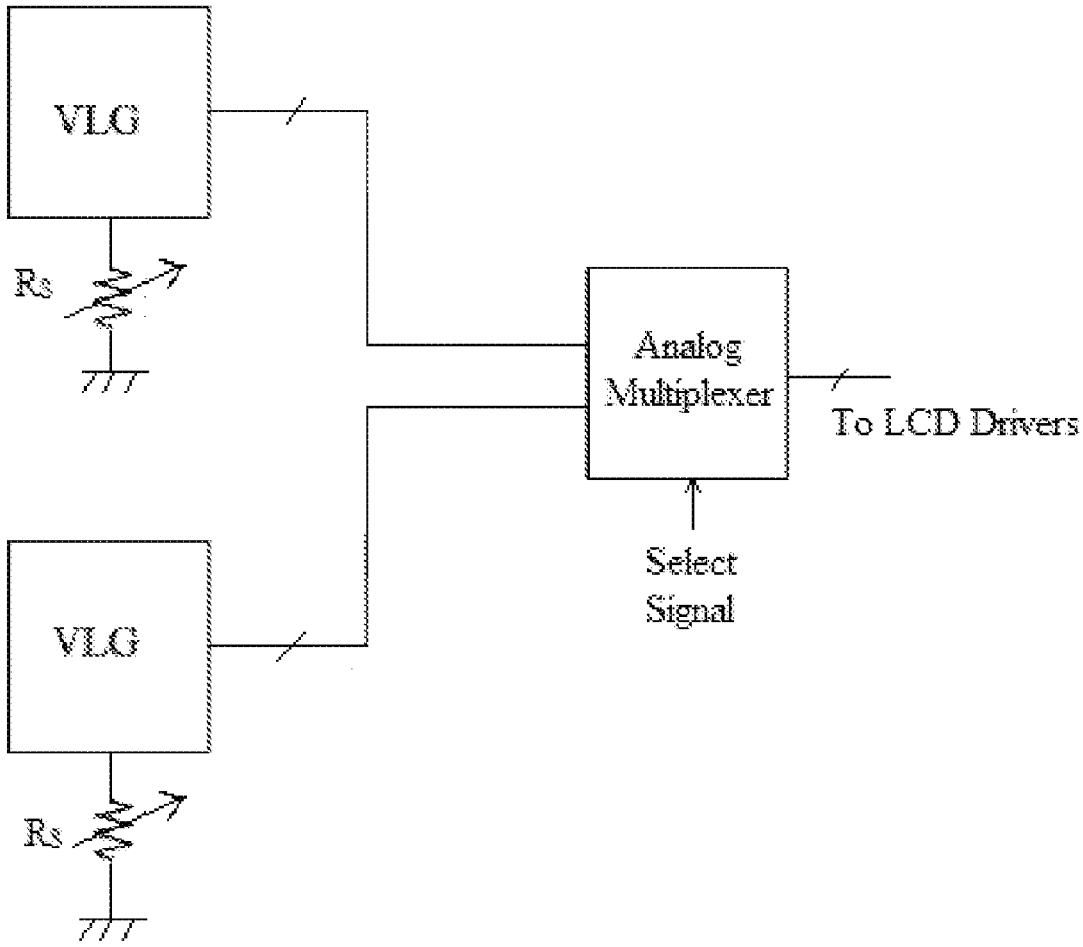

Another main embodiment of the present invention is a device to optimize power consumption and improve brightness uniformity of pixels in Liquid Crystal Display, wherein said device comprises: voltage level generator (VLG) to provide voltages to the drivers, and analog multiplexer (number of steps: 1) with variable resistor (Rs) connected to the VLG wherein Rs is dictated by multi-step waveform to determine the voltage applied to the LCD as shown in the FIG. 13.

In yet another embodiment of the present invention, the VLG is generated by multiplexing 2 VLG's with a selection bit as shown in the FIG. 13.

In still another embodiment of the present invention the multiplexer that are common to drivers reduces number of voltages selected inside multi-stage drivers.

Line-by-Line Addressing with Duty Cycle Control

Power consumed by the display panel depends on the number of transitions in the voltage across the pixels and the magnitude of these transitions. Number of transitions in turn depends on the image being displayed and the addressing technique. Number of transitions in the addressing waveform can be made independent of the image if the voltage in the row and column waveforms is chosen to be the same for a fraction ($T_0$) of the row select time T. This introduces transitions in both row and column waveforms and the voltage across the pixel is zero during the interval $T_0$. Amplitude of the row and column waveforms has to be increased by a factor $$\sqrt{\left(\frac{T}{T-T_0}\right)}$$

to ensure that the rms voltage across pixel is same as that of the conventional line-by-line addressing technique. This technique will be referred to as line-by-line addressing with duty cycle control. Introduction of duty cycle has the advantage of good brightness uniformity of pixels [4]. Although the number of transitions is the same across all pixels, power consumption depends on the number of pixels in the ON and OFF states because the capacitance of the pixel depends on its state. Power consumption of the multiplexed display driven by line-by-line addressing when 50% of the pixels are driven to ON state is given in (7).

$$P_{line\text{-}by\text{-}line\ with\ duty\ cycle} = MV_c^2 X\left(\frac{T}{T-T_0}\right)f \tag{7}$$

Wherein $$X=[C_{on}(N^2+N\sqrt{N})+C_{off}(N^2-N\sqrt{N})] \tag{8}$$

Power consumption (as a function of N) of a display driven by the line-by-line addressing with duty cycle is compared with that of a display driven by conventional line-by-line addressing in FIG. 2. This comparison is done when the three specific patterns (case I to III) are displayed. These plots are based on the assumption that $C_{on}=2C_{off}$ and $T_0=0.05T$. Least amount of power is consumed when all the pixels in the display are OFF and the number of polarity reversals in a frame ($n_p$) is one. Hence, the power consumption is normalized to the minimum power in these plots.

Normalized power consumption as a function $n_p$, the number of polarity inversions in a frame (when N, the number of lines multiplexed is 100) is plotted in FIG. 3. Power consumption while displaying blank patterns increases with $n_p$ because the number of transitions in waveforms increases with the $n_p$. In case of the checkerboard pattern, the power consumption decreases with $n_p$ due to a decrease in number of transitions with increase in $n_p$. Power consumption of the line-by-line addressing technique with duty cycle control is also shown in the FIG. 2. Power consumption of the line-by-line addressing with duty cycle control also depends on the image because the capacitances of the ON and OFF pixels are not equal although, the number of transitions in the addressing waveforms are equal. Introduction of duty cycle improves the brightness uniformity of pixels in the display because the waveforms across all the pixels are distorted to the same extent (since number of transitions are equal) and the reduction in RMS voltage across the pixels can be compensated by just increasing the peak amplitude of the pulses. We have also considered some typical images of size 100×100 pixels and we have estimated the power consumption when these images are displayed. The results are summarized in Table II.

TABLE II

NORMALIZED POWER CONSUMPTION FOR SOME TEST IMAGES

| | Line-by-line addressing with duty cycle control | Line-by-line addressing with $n_p$ polarity reversals per frame (without duty cycle) | | | |
|---|---|---|---|---|---|
| Image | ($T_0$ = 0.05 T) | $n_p$ = 1 | $n_p$ = 25 | $n_p$ = 50 | $n_p$ = 100 |
| 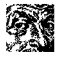 | 3.3917 | 2.3911 | 2.7849 | 3.2277 | 4.0621 |
| 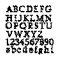 | 3.8911 | 2.2777 | 2.9791 | 3.7014 | 5.1211 |
| 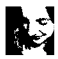 | 2.9960 | 1.5913 | 2.2226 | 2.8566 | 4.1311 |
| 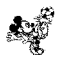 | 3.8370 | 2.2219 | 2.9283 | 3.6480 | 5.1037 |
| 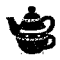 | 3.3553 | 1.8255 | 2.4867 | 3.2064 | 4.5881 |

Power consumptions shown in the Table II are normalized to that of the blank pattern with all the pixels in OFF state and having just one polarity reversal per frame. It is evident from the table that the power consumption of line-by-line addressing when the duty cycle control is introduced is about the same as that of line-line addressing wherein the polarity is reversed after scanning every two-address line. Analysis presented in this section implies that the introduction of duty cycle will not reduce the power consumption in multiplexed matrix LCDs although it is quite effective in reducing the power consumption in non-multiplexed displays. Principle of a new technique to reduce power consumption in multiplexed as well as non-multiplexed displays is presented next.

Principle of Reducing Power Consumption

It is well known that the power dissipated in the resistor while charging or discharging a capacitor in a RC circuit using a single step of amplitude $V_p$ is given by $$\frac{CV_p^2}{2}.$$

Hence, the total power consumed during a charge-discharge cycle is $CV_p^2$. Now, if the capacitor is charged and discharged using two steps, each of amplitude $$\frac{V_p}{2}$$

then the power consumption will be $$\frac{CV_p^2}{2}$$

i.e. 50% of the power dissipated as compared to a single pulse of amplitude $V_p$. Similarly, the power consumption can be reduced by a factor 's' by introducing 's' steps to charge a capacitor to a voltage $V_p$ and using an equal number of steps to discharge it to ground potential.

We propose to use the multi-step voltage profile shown in FIG. 4 to reduce the power consumption in multiplexed as well as non-multiplexed displays. It has (s−1) ascending and descending steps of equal duration $T_s$ while the final step with a maximum voltage of V lasts for the duration $T_f$. Amplitude of the multi-step voltage profile is zero during the period $T_o$. Step size of the ascending as well as descending steps are equal (V/s) and the total period is $T=2(s-1)T_s+T_f+T_0$. This multi-step profile reduces to the single pulse of the conventional addressing technique when s=1 and $T_0=0$ as shown in the FIG. 4 using dashed lines. LCDs are slow responding devices and their response times are usually in milliseconds. The response depends on the energy delivered to the pixel and the actual wave shape is not important as long as the period of the waveform is small as compared to the response times. Hence, the RMS voltage across the pixel decides the state of the pixel. Peak amplitude (V) of the multi-step voltage profile that will deliver the same energy as a pulse of amplitude $V_p$ and of duration T can be obtained equating the RMS voltage of the multi-step voltage profile to that of a pulse as shown in (9).

$$\sqrt{\frac{1}{T}\left\{2\sum_{i=1}^{s-1}\left(\frac{V}{s}\cdot i\right)^2 T_s + V^2 T_f\right\}} = V_p \tag{9}$$

$$\sqrt{\frac{V^2}{T}\left[\left(\frac{(s-1)(2s-1)}{3s}\right)T_s + (T - T_0 - 2(s-1)T_s)\right]} = V_p \tag{10}$$

Hence the maximum amplitude of the multi-step profile is $$V = \sqrt{\frac{T}{T-T_0}\left(\frac{3s(T-T_0)}{3s(T-T_0)-(4s+1)(s-1)T_s}\right)}\cdot V_p \tag{11}$$

FIG. 5 shows the peak amplitude V of the multi-step voltage profile as a function of the duration $T_s$, normalized to T for several values of 's', the number of steps. The peak voltage increases with $T_s$ and it is preferable to choose a small value for $T_s$. The peak voltage decreases and approaches the magnitude of a single pulse in the conventional line-by-line addressing as $T_f$, the duration of the maximum voltage is increased. The power dissipated in the resistor while charging and discharging a pixel (capacitor) by applying the waveform shown in FIG. 4 is given in the following expression.

$$\begin{aligned} P_{multi\text{-}step} &= sC\left(\frac{V}{s}\right)^2 \\ &= C\frac{T}{T-T_0}\left(\frac{3(T-T_0)}{3s(T-T_0)-(4s+1)(s-1)T_s}\right)V_p^2 \end{aligned} \tag{12}$$

Power consumed when a pixel is charged and discharged with a pulse of duration $(T-T_0)$ is given in (13).

$$P_{pulse} = C\left(\frac{T}{T-T_0}\right)V_p^2 \tag{13}$$

Reduction in power consumption while using the multi-step voltage profile as compared to that of a pulse is given in the following expression.

$$\frac{P_{multi\text{-}step}}{P_{pulse}} = \left(\frac{3(T-T_0)}{3s(T-T_0)-(4s+1)(s-1)T_s}\right) \tag{14}$$

This ratio of power consumption as a function the step width $T_s$ normalized to the select time T is shown in FIG. 6 for several values of 's', the number of steps in the multi-step voltage profile.

Power consumption decreases with the increase in the number of steps (s). A good reduction in power consumption can be achieved with just two steps as long as the duration $T_s$ is small. A large value of $T_s$ decreases $T_f$ (the duration of the maximum voltage V) while increasing the amplitude of V and this is not favorable for reducing the power consumption. A line-by-line addressing technique incorporating the multi-step voltage profile is proposed in the following section to reduce the power consumption in passive matrix LCDs.

Line by Line Addressing with Multi-Step Waveforms

Let us consider the conventional line-by-line addressing technique and replace the pulses in the row and column waveforms with the multi-step profiles as shown in FIG. 7. Let $V_x$ and $V_y$ be the maximum amplitudes of row and column voltages. The RMS voltage across a pixel is as follows.

$$V_{RMS} = \sqrt{\frac{1}{NT}[E_{select} + (N-1)E_{non\,select}]} \tag{15}$$

Here, $E_{select}$ is the energy delivered to a pixel during the select interval T. Energy delivered to the pixel during the rest of the (N−1) row select intervals when the other rows in the matrix are selected is given by $E_{non\ select}$.

$$E_{select} = 2\sum_{i=1}^{s-1}\left(\frac{(V_x \pm V_y)}{s}i\right)^2 T_s + (V_x \pm V_y)^2 T_f \tag{16}$$

The instantaneous voltage across an ON pixel is $(V_x+V_y)$, while it is $(V_x-V_y)$ across an OFF pixel. This is shown by the symbol '±' in (16).

$$E_{non\ select} = 2\sum_{i=1}^{s-1}\left(\frac{V_y}{s}i\right)^2 T_s + V_y^2 \cdot T_f \tag{17}$$

$$V_{RMS} = \sqrt{\left(\frac{3s(T-T_0)-(4s+1)(s-1)T_s}{3sT}\right)\cdot\left(\frac{V_x^2 \pm 2V_xV_y + NV_y^2}{N}\right)} \tag{18}$$

It can be shown that the selection ratio $$\left(\frac{V_{ON}(\mathrm{RMS})}{V_{OFF}(\mathrm{RMS})}\right)$$

will be a maximum when the condition $V_x=\sqrt{N}V_y$ is satisfied.

Expression for the RMS voltage across a pixel in a display driven by the conventional line-by-line addressing technique is $$V_{RMS\ conventional} = \sqrt{\frac{V_r^2 \pm 2V_rV_c + NV_y^2}{N}} \tag{19}$$

It is similar to (18) expect for the first term in (18). We can show that the maximum amplitude of the step voltage profiles are related to that of the conventional line-by-line addressing as shown in (20) and (21)

$$V_x = \sqrt{\left(\frac{3sT}{3s(T-T_0)-(4s+1)(s-1)T_s}\right)}\cdot V_r \tag{20}$$

$$V_y = \sqrt{\left(\frac{3sT}{3s(T-T_0)-(4s+1)(s-1)T_s}\right)}\cdot V_c \tag{21}$$

The multiplying factor is the same for both row and column waveforms and is similar to that in (11) of section V. Number of transitions across the pixels is independent of the image when the duty cycle control is introduced with a finite $T_0$. Here, the power consumption depends just on the number of ON and OFF pixels in the image because the capacitance of the ON and OFF pixels are not equal. It does not depend on the number of polarity inversions or the data sequences involved in forming the image. Expressions for the power consumed by ON and OFF pixels are given in (22) and (23) respectively.

$$P_{ON\ pixel} = \frac{sC_{ON}}{NT}\left[\left(\frac{V_x+V_y}{s}\right)^2 + (N-1)\left(\frac{V_y}{s}\right)^2\right] \tag{22}$$

$$P_{OFF\ pixel} = \frac{sC_{OFF}}{NT}\left[\left(\frac{V_x-V_y}{s}\right)^2 + (N-1)\left(\frac{V_y}{s}\right)^2\right] \tag{23}$$

Power consumption of the display is given in (24). Here, $x_j$ is the number of ON pixels in the display with N rows and M columns.

$$P = x_jP_{ON\ pixel} + (N\cdot M - x_j)P_{OFF\ Pixel} \tag{24}$$

Ratio of power consumption of multi-step line-by-line addressing to that of conventional line-by-line addressing with duty cycle control is given by $$\frac{P_{multi\text{-}step}}{P_{pulse}} = \left(\frac{3(T-T_0)}{3s(T-T_0)-(4s+1)(s-1)T_S}\right) \tag{25}$$

This factor is same as that in (14) and hence comparison of the power consumption shown in FIG. 6 holds good for the line-by-line addressing with multi-step voltage profile.

Static Drive with Multi-Step Waveforms

A non-multiplexed display can be treated as a special case of a matrix display having just one row (N=1). Typical multi-step waveforms for a non-multiplexed display are shown in FIG. 8.

Analysis with Distortion in the Multistep Waveform:

The analysis presented in [3] is based on the assumption that the time constant (τ=RC) of the drive circuit is small as compared to the step width ($T_s$). It depends on the number of steps (s) in the multi-steps, frame refresh frequency (f), $T_f$ duration of the voltage V, and the number of lines that are multiplexed (N) in the display. The time constant (τ) may become comparable to the step width ($T_s$) as the select time ($T=T_f+(2\cdot s-1)T_s$) decreases with increasing N and s. Then the decrease in the rms voltage across the pixel due to the distortion in the addressing waveforms will no longer be negligible. Effects of RC distortion on the rms voltage, power dissipation and the peak voltage in multi-step and conventional pulse based waveforms are presented in the following section.

I. Analysis of Multi-Step Waveforms with Distortion

Let us consider a multi-step waveform profile with RC distortion as the select waveform. It has a period (T) as shown in FIG. 9.

Each ascending and descending step has a duration $T_s$ while the peak voltage is applied during $T_f$. The ideal waveform without distortion is shown using dotted lines. The waveform profile in FIG. 9 may be split into four distinct intervals as given below.

i) Ascending steps of duration $T_s$.

ii) Flat region (at the top) of duration $T_f$ when the voltage is V).

iii) Descending steps of duration $T_s$.

iv) Duration $T_L$, when the voltage applied to the pixel is zero to ensure full discharge of voltage across the pixel.

Piecewise expression for the voltage across a pixel during an ascending step is given by:

$$V_{pixel}(t) = k\frac{V}{s} - \frac{V}{s}\left(\sum_{j=0}^{k-1} e^{-\frac{jT_s}{\tau}}\right)e^{-\frac{t-T_s(k-1)}{\tau}} \tag{3}$$

This expression is valid for the $k^{th}$ ($1 \leqq k \leqq s-1$) ascending step in the interval $(k-1)T_s \leqq t \leqq kT_s$. Similarly the expression for descending steps is as follows:

$$V_{pixel}(t) = \frac{V}{s}\left((s-k) + c_k e^{-\frac{t-T_f-T_s(s+k-2)}{\tau}}\right) \quad (4)$$

$$\text{Wherein } c_k = \left[\left(\sum_{j=0}^{k-1} e^{-\frac{jT_s}{\tau}}\right) - \left(\sum_{j=0}^{s-1} e^{-\frac{jT_s}{\tau}}\right) e^{-\frac{T_s(k-1)+T_f}{\tau}}\right] \quad (5)$$

The expression in (27) is valid for the $k^{th}$ ($1 \leqq k \leqq s-1$) descending step when the pixel is discharged to a lower voltage during the interval $((s+k-2)T_s+T_f) \leqq t \leqq ((s+k-1)T_s+T_f)$. When the time constant is large, the voltage across the pixel (capacitor) may not discharge completely during $T_L$. The residual voltage across the pixel at the end of each select time will change the waveform across the pixel in successive time intervals. As a result, the rms voltage (across the pixel) will depend on the sequence of voltages in the addressing waveform, which in turn depends on the image that is displayed. Pixels that are driven to the same state in different columns in the matrix display will have different sequence of voltages and hence the rms voltage across them will not be equal. It results in poor brightness uniformity of pixels in the display. In order to maintain good brightness uniformity and avoid cross talk, we propose to apply a negative voltage (β) during $T_L$ as shown in the FIG. 9, that will force the pixels to discharge completely. The negative voltage (β) is given in the following expression:

$$\beta = \left(\frac{V}{s}\right)\left(\frac{1}{1-e^{\frac{T_0}{\tau}}}\right)\left[\left(\sum_{j=0}^{s-1} e^{-\frac{jT_s}{\tau}}\right) - \left(\sum_{j=0}^{s-1} e^{-\frac{jT_s}{\tau}}\right) e^{-\frac{T_s(k-1)+T_f}{\tau}}\right] \quad (6)$$

Voltage across the pixel during subsequent time intervals will not depend on the voltage across the pixel during the select time because the voltage across the pixel is fully discharged within (T) by applying a voltage of opposite polarity as shown in the FIG. 9, even when the time constant is large. The analysis is valid irrespective of the time constant and such a voltage profile can substitute a pulse in any addressing scheme. Energy delivered to a pixel during the select time T is computed as follows:

$$E_{RC\ distortion} = \left[E_s + E'_s + \left(\sum_{k=1}^{s-1} E_k\right) + \left(\sum_{k=1}^{s-1} E'_k\right)\right] \quad (30)$$

Wherein $E_k$ (or $E'_k$); energy delivered to the pixel, is obtained by squaring and integrating the instantaneous voltage across the pixel i.e. $V_{pixel}(t)$ over the duration of the $k^{th}$ ($1 \leqq k \leqq s-1$) ascending (or descending) step i.e.

$$E_k = \int_{(k-1)T_s}^{kT_s} \frac{(V_{pixel}(t))^2}{R} dt \quad (31)$$

$E_s$ and $E'_s$ correspond to the energy delivered during $T_f$ and $T_L$ respectively. The power dissipation over a row select time expressed as $$P(RC\ \text{distortion}) = \frac{1}{T}\left[P_s + P'_s + \left(\sum_{k=1}^{s-1} P_k\right) + \left(\sum_{k=1}^{s-1} P'_k\right)\right] \quad (32)$$

Here, $P_k$ and $P'_k$ represent the power dissipated during the $k^{th}$ ascending and descending steps respectively. Whereas $P_s$ and $P'_s$ correspond to the durations $T_f$ and $T_L$ respectively.

The energy delivered is less than that of the ideal waveform profile due to the distortions in the waveform and the introduction of negative voltage (β). In order to achieve the same effect as that of a single pulse the energy has to be same because LCDs are rms responding devices. The overall decrease in the energy delivered to the pixel can be increased by increasing the amplitude using one of the three possible correction methods outlined here:

1) Amplitude of the first step is increased.
2) Amplitude of all the steps are uniformly increased.
3) Amplitude of the topmost i.e. $s^{th}$ step is increased.

Increase in peak amplitude for scheme 2 can be analytically obtained as follows. If $$\gamma = \frac{E_{ideal}}{E_{RC\text{-}distortion}}$$

then the excitation voltages of all the steps have to be increased by a factor $\sqrt{\gamma}$ to obtain the energy of the ideal waveforms even when the waveforms are distorted. Power dissipation also increases by a factor γ i.e., the above expression is multiplied by this factor. It is not possible to estimate the increase in peak amplitude and power dissipation for cases 1 and 3 analytically. However, they can be estimated numerically. The three methods of correcting the energy in the select profile may be compared using the following criteria:

1. Increase in the peak voltage.
2. Reduction in power dissipation.

We found the increase in the amplitude of the peak voltage is the least when the amplitude of the first step alone is corrected (case 1); and it also has the lowest power dissipation over a range of time constants.

Application of a negative voltage to bring the voltage across the pixel to zero at the end of the select time interval (without affecting the energy delivered during the select time) ensures that the power dissipation due to one pixel does not depend on the states of the neighboring pixels just as the introduction of a short duration of zero voltage across the pixel in [3]. We have included these corrections in further analysis and comparison of power dissipation and supply voltage in this paper.

Figure 10:
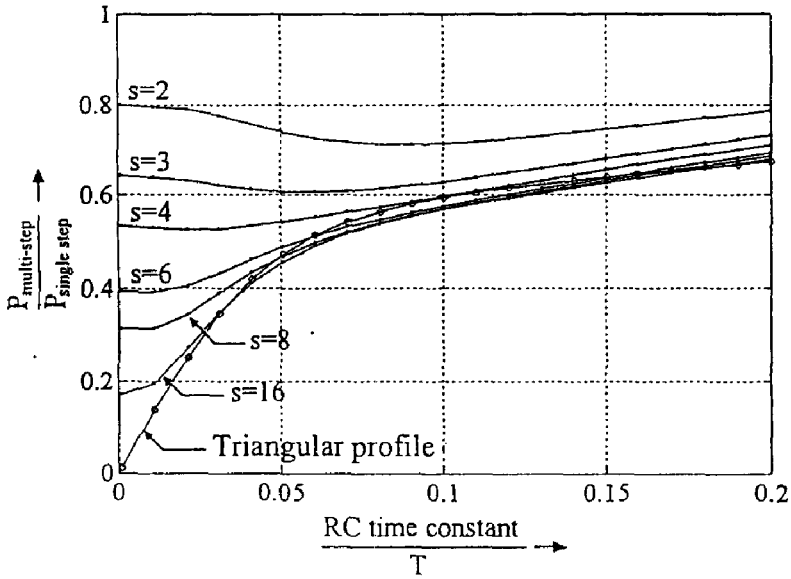
Figure 11:
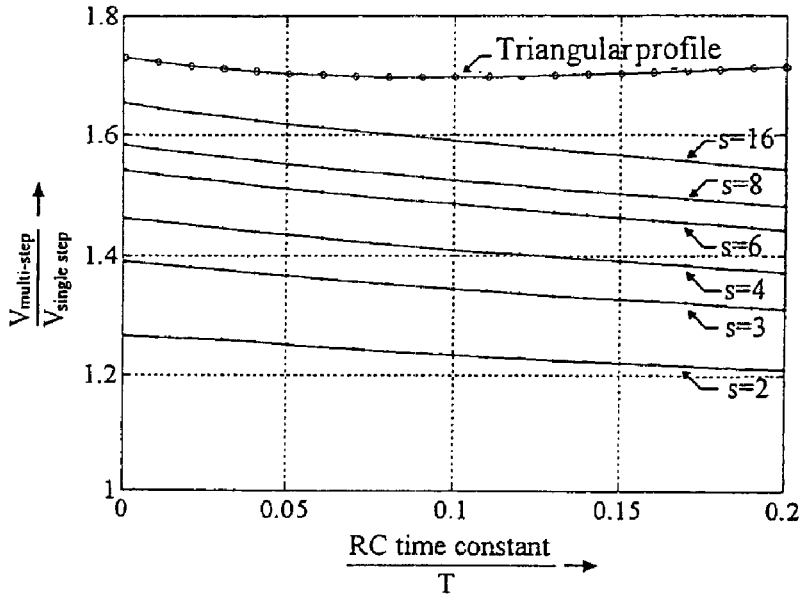

Power dissipation of the multi-step waveform as compared to the power dissipation of a single pulse (having the same duty cycle) is plotted as a function of the RC time constant (τ) in FIG. 10. The durations $T_L$ and $T_f$ are chosen to be 0.1T and $2T_s$ respectively. The power dissipation decreases significantly with increase in s when the time constant is small. Saving in power achieved by increasing s is small when the time constant is large. About 30% reduction in power dissipation can be achieved with just three steps when τ=0.2T. The multi-step profile tends towards a triangular waveform when the number of steps is greater than 3 and $T_f=2T_s$ as discussed in section IV. Power dissipation of a triangular waveform is plotted in FIG. 10 for comparison. The triangular waveform has the lowest power dissipation, especially for small values of τ. However, it is achieved with a 70% increase in the peak voltage. FIG. 11 compares the supply voltage of the multi-step waveform with that of a single pulse for various values of τ and s. It is evident from the plots in FIGS. 10 and 11 that at lower values of time constant τ, a large reduction in power can be achieved with higher values of s and consequently a higher supply voltage. However, it may be adequate to choose a small value of s because it is possible to achieve reasonable reduction in power with a moderate increase in supply voltage when τ is large.

Figure 12:
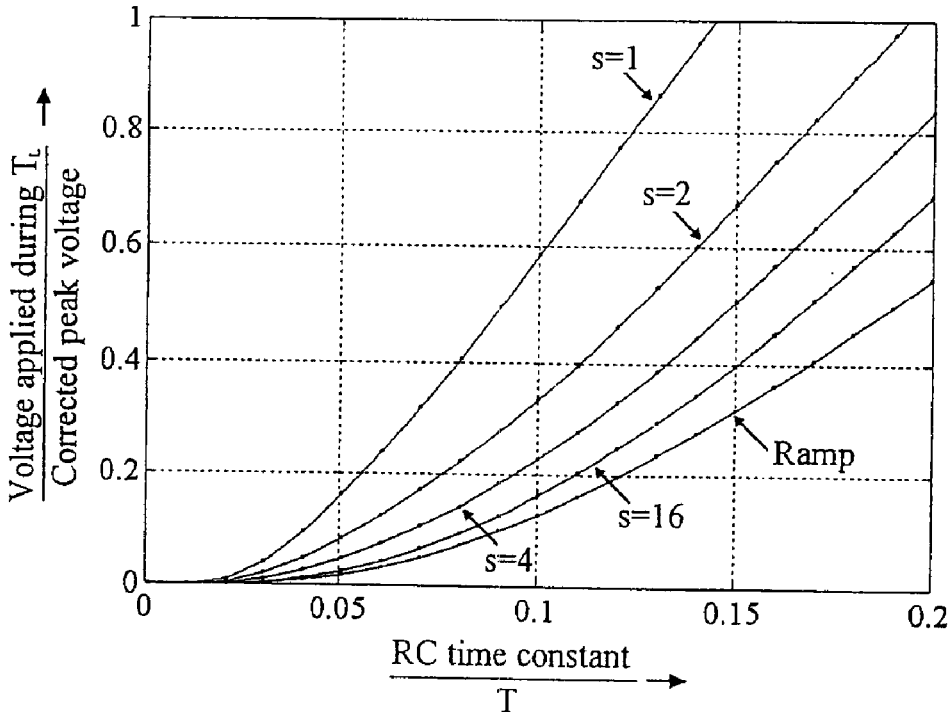

Amplitude of the voltage (β), applied during $T_L$ to completely discharge the pixel within the select time is plotted in FIG. 12 as a function of the time constant τ. It is normalized to the peak voltage for the corresponding number of steps (s). Amplitude of β is comparable to the peak voltage when τ is large. However, most of the addressing techniques, especially multi-line techniques have both positive and negative voltages and hence the supply voltage of the driver circuit will not double in such cases.

As the number of steps is increased, the multi-step waveforms tend towards triangular or trapezoidal profiles [4]. They have a gradual change in amplitude and do not have any abrupt changes, which contribute to higher power dissipation while charging and discharging pixels.

CONCLUSION

The fundamental nature of the idea of substituting multi-step voltage profiles in place of a single voltage of a pulse to reduce power consumption ensures that it will hold good in combination with any other addressing technique suitable for driving the RMS responding matrix LCDs. Scaling of amplitude of the row and column waveforms and the reduction in power consumption etc., will be the same as the outcome of the analysis presented in the section V. The multi-step voltage profile reduces to a triangular waveform when $s \rightarrow \infty$. Application of such triangular waveforms to drive the matrix display is outside the scope of this paper and it will be presented elsewhere.

I claim:

1. A method to reduce power dissipation and improve brightness uniformity of pixels in a Liquid Crystal Display (LCD), wherein said method comprises steps of:

substituting a multi-step waveform having a predefined ($V_x$) to replace each and every pulse in row waveforms that are applied to a predetermined number of rows of the LCD; and replacing each and every data pulse in data waveforms applied to all columns with a multi-step waveform having a predefined peak amplitude ($V_y$) by choosing the sign of $V_y$ to be the same as that of the data pulse to achieve predefined root mean square (rms) voltages across pixels, wherein said multi-step waveform comprising ascending and descending steps having a predefined step-width ($T_s$) and a period (T) and the last step ($T_L$) of the multi-step waveform comprises a voltage (β) having a polarity that is opposite to that of a peak voltage ($T_f$) to bring a row select voltage to zero at the end of period T to improve brightness uniformity of pixels.

2. The method as claimed in claim 1, wherein a number of steps ranges from 2 to 16.

3. The method as claimed in claim 1, wherein the predetermined step-width ($T_s$) is not the same for all steps in row waveforms.

4. The method as claimed in claim 1, wherein an amplitude of the voltage applied during $T_L$ is less than or equal to the peak amplitude of the multi-step waveform.

5. The method as claimed in claim 1, wherein an amplitude of the first step of the multi-step waveform is increased as compared with an amplitude of a first step in a multi-step waveform without distortion such that an energy of the multi-step waveform is equal to the energy of the multi-step waveform without distortion.

6. The method as claimed in claim 1, wherein an amplitude of all steps of the multi-step waveform is increased as compared to a multi-step waveform without distortion so that energy of the multi-step waveform is equal to the energy of the multi-step waveform without distortion.

7. The method as claimed in claim 1, wherein a peak amplitude of the multi-step waveform is increased as compared to the multi-step waveform without distortion so that the energy of the multi-step waveform is equal to the energy of the multi-step waveform without distortion.

8. The method as claimed in claim 1, wherein pulses in the waveforms applied to the rows and the waveforms applied to the columns to drive the LCD are replaced with multi-step waveforms with predetermined peak voltages.

9. The method as claimed in claim 1, wherein the multi-step waveforms are employed to drive large pixels with high capacitance in non-multiplexed displays.

10. The method as claimed in claim 1, wherein an amplitude of a first step alone is increased to achieve minimal increase in supply voltage of the drivers as compared to the multi-step waveform with increase in amplitude of all steps or the final step.

11. The method as claimed in claim 1, wherein the amplitude of the first step is increased to achieve less power dissipation in the drivers as compared to the multi-step waveform without increasing the first step.

12. The method as claimed in claim 1, wherein a reduction of power dissipation in drivers is achieved LCDs addressed with line-line addressing and multi-line addressing by replacing pulses in addressing waveforms with multi-step waveforms.

13. The method as claimed in claim 1, wherein the amplitude of peak voltage ($V_x$, $V_y$) of the multi-step waveforms is the same for the pulses substituted in the backplane waveform and data waveforms of a non-multiplexed LCD.

14. A device to optimize power consumption and improve brightness uniformity of pixels in a Liquid Crystal Display (LCD), wherein said device comprises:

a first voltage level generator (VLG) and a second VLG to provide voltages to the LCD drivers; and an analog multiplexer with a variable resistor (Rs) connected to each VLG, wherein Rs is dictated by a multi-step waveform to determine the voltage applied to the LCD, wherein the multi-step waveform comprises a predefined peak amplitude ($V_x$) to replace each and every pulse in row waveforms that are applied to a predetermined number of rows of the LCD, the replaced each and every data pulse in data waveforms applied to all columns with a multi-step waveform having a predefined peak amplitude ($V_y$) by choosing the sign of $V_y$ to be the same as that of the data pulse to achieve predefined root mean square (rms) voltages across pixels, and wherein said multi-step waveform comprising ascending and descending steps having a predefined step-width ($T_s$) and a period (T) and the last step ($T_L$) of the multi-step waveform comprises a voltage (β) having a polarity that is opposite to that of a peak voltage ($T_f$) to bring a row select voltage to zero at the end of period T to improve brightness uniformity of pixels.

15. The device as claimed in claim 14, wherein the voltages generated in the first VLG and the second VLG are multiplexed with a selection bit before feeding to the drivers.

16. The device as claimed in claim 14, wherein the multiplexer that is common to the drivers reduces the number of voltages that are selected by the drivers.

* * * * *

UNITED STATES PATENT AND TRADEMARK OFFICE

CERTIFICATE OF CORRECTION

PATENT NO. : 8,111,228 B2
APPLICATION NO. : 11/819039
DATED : February 7, 2012
INVENTOR(S) : T. N. Ruckmongathan It is certified that error appears in the above-identified patent and that said Letters Patent is hereby corrected as shown below:

Col. 13,

Claim 1, lines 39-40 insert

--peak amplitude-- between “having a predefined” and “(Vx)”

Signed and Sealed this
Twenty-fourth Day of April, 2012

David J. Kappos

David J. Kappos
*Director of the United States Patent and Trademark Office*